US005499906A

United States Patent [19]

O'Leary

[11] Patent Number: 5,499,906

[45] Date of Patent: Mar. 19, 1996

[54] IV FLUID DELIVERY SYSTEM

[75] Inventor: Stephen H. O'Leary, Encinitas, Calif.

[73] Assignee: IVAC Corporation, San Diego, Calif.

[21] Appl. No.: 287,624

[22] Filed: Aug. 8, 1994

[51] Int. Cl.[6] ..... F04B 43/08

[52] U.S. Cl. ..... 417/53; 417/474; 417/479; 604/153

[58] Field of Search ..... 417/474, 478, 417/479, 53; 604/153

[56] References Cited

U.S. PATENT DOCUMENTS

| | | | |
|---|---|---|---|
| 2,105,200 | 1/1938 | Phelps | 128/230 |
| 2,351,828 | 6/1944 | Marsh | 103/148 |
| 2,412,397 | 12/1946 | Harper | 103/148 |
| 3,083,647 | 4/1963 | Muller | 103/148 |
| 3,314,371 | 4/1967 | Hopkinson | 103/148 |
| 3,433,171 | 3/1969 | Corneil | 417/474 |
| 3,518,033 | 6/1970 | Anderson | 417/478 |
| 3,606,596 | 9/1971 | Edwards | 417/479 |
| 4,039,269 | 8/1977 | Pickering | 417/475 |
| 4,137,940 | 2/1979 | Faisandier | 137/486 |
| 4,199,307 | 4/1980 | Jassawalla | 417/474 |
| 4,236,880 | 12/1980 | Archibald | 417/478 |
| 4,273,121 | 6/1981 | Jassawalla | 128/214 |
| 4,277,226 | 7/1981 | Archibald | 417/38 |
| 4,302,164 | 11/1981 | Manella | 417/474 |
| 4,303,376 | 12/1981 | Slekmann | 417/360 |
| 4,410,322 | 10/1983 | Archibald | 604/153 |
| 4,479,797 | 10/1984 | Kobayashi et al. | 604/153 |
| 4,519,792 | 5/1985 | Dawe | 604/152 |
| 4,559,038 | 12/1985 | Berg et al. | 604/153 |
| 4,561,830 | 12/1985 | Bradley | 417/474 |
| 4,653,987 | 3/1987 | Tsuji et al. | 417/360 |
| 4,657,490 | 4/1987 | Abbott | 417/478 |
| 4,893,991 | 1/1990 | Hemingway et al. | 417/53 |
| 4,952,124 | 8/1990 | Ogami | 417/474 |
| 4,967,940 | 11/1990 | Blette et al. | 222/214 |
| 5,055,013 | 10/1991 | Faeser | 417/474 |
| 5,056,992 | 10/1991 | Simons et al. | 417/474 |
| 5,092,749 | 3/1992 | Meijer | 417/474 |
| 5,116,203 | 5/1992 | Natwick et al. | 417/53 |
| 5,151,019 | 9/1992 | Danby et al. | 417/474 |
| 5,152,680 | 10/1992 | Okada | 417/474 |
| 5,158,437 | 10/1992 | Natwick et al. | 604/153 |
| 5,165,873 | 11/1992 | Meijer | 417/474 |
| 5,199,852 | 4/1993 | Danby | 417/26 |
| 5,217,355 | 6/1993 | Hyman et al. | 417/474 |
| 5,302,093 | 4/1994 | Owens et al. | 417/474 |
| 5,320,502 | 6/1994 | Davis | 417/474 |
| 5,320,503 | 6/1994 | Davis | 417/474 |
| 5,322,422 | 6/1994 | Natwick et al. | 417/474 |

OTHER PUBLICATIONS

Copending U.S. Application No. 08/287,625, filed Aug. 8, 1994.

Copending U.S. Application No. 08/187,853, filed Aug. 8, 1994.

Copending U.S. Application No. 08/287,854, filed Aug. 8, 1994.

*Primary Examiner*—Peter Korytnyk

*Attorney, Agent, or Firm*—Fulwider Patton Lee & Utecht

[57] ABSTRACT

An IV fluid delivery system for use in connection with a resilient, deformable tube, wherein pinching fingers occlude the tube and pumping fingers deform the tube (without occluding it) against a first pressure pad or support means in a pumping action, while restoring fingers urge the tube against a second pressure pad or support means to restore its cross-sectional shape, so as to improve the accuracy, consistency, and predictability of flow through the tube.

15 Claims, 5 Drawing Sheets

IV FLUID DELIVERY SYSTEM

BACKGROUND OF THE INVENTION

This invention generally relates to fluid delivery systems that are used to administer medical solutions to patients intravenously. More specifically, the invention relates to intravenous (IV) pumps with a mechanism for improving the predictability, consistency, reliability, and accuracy of fluid flow.

Physicians and other medical personnel apply IV infusion therapy to treat various medical complications in patients. For safety reasons and in order to achieve optimal results, it is desirable to administer the IV fluid in accurate amounts as prescribed by the physician and in a controlled fashion. Certain IV delivery systems use a simple arrangement, whereby the IV fluid flows from an elevated reservoir via a length of flexible tubing connected by a catheter or the like to the patient's vascular system. In these systems, a manually adjustable clamp is used to apply pressure on the tubing to control the cross-sectional area of the tube opening to thereby control the flow rate. However, due to factors such as temperature changes which can affect the shape of the tubing, and the unpredictability of the interaction between the tubing and the clamp, such systems have not proven to be very accurate in controlling and maintaining a prescribed fluid flow rate over an extended period of time. Moreover, delivery pressure is limited in a practical sense by the head height of the fluid source and, in many instances, a greater delivery pressure is required to accomplish the desired IV infusion to the patient.

Over the years, various devices and methods have been developed to improve the administration of IV fluids under positive pressure in a controlled and accurate fashion. One such example can be found in peristaltic pumps which act on a portion of the tubing carrying the IV fluid between a fluid reservoir and the patient to deliver fluid under pressure and to control the flow rate. More specifically, a peristaltic pump is a mechanical device that pumps the fluid in a wave-like pattern by sequential deformation and occlusion of several points along the length of the resilient, deformable tubing which carries the IV fluid. Operation of such a pump typically involves a mechanical interaction between a portion of the resilient, deformable tubing, a peristaltic mechanism (i.e., a mechanism capable of creating a wave-like deformation along the tube), a pressure pad for supporting the tube, and a drive mechanism for operating the peristaltic mechanism.

In such a system, the tubing is placed between the peristaltic mechanism and the pressure pad so that the peristaltic mechanism can sequentially deform and create a moving zone of occlusion along the portion of the tube. The speed of the drive mechanism may be adjusted to control the pumping cycle and to achieve the desired flow rate. As known by those skilled in the art, peristaltic pumps have provided a major improvement over older methods in achieving consistency and accuracy in the flow rate of the IV fluid.

Another example of improved fluid delivery systems can be found in pumps with multiple fingers, whereby some fingers pinch and occlude the tube and some fingers deform the tube without occluding it. For example, some multi-finger pumps employ three or four fingers, wherein the fingers that occlude the tube and the fingers that do not occlude the tube are typically located in alternating fashion along the length of the pump. At any given time, one of the fingers is occluding the tube, while other fingers alternatingly go through their pumping (closing) and filling (retracting) strokes. The movement of the fingers is synchronized so as to force the fluid to flow inside the tube from the upstream end of the pump to the downstream end of the pump, and eventually to the patient.

It has been found desirable to increase the uniformity of the fluid flow rate and one factor that directly affects fluid flow in a fluid delivery pump is the cross-sectional area of the tube lumen or opening. Generally, IV sets that are used with fluid delivery pumps have resilient, deformable tubes (typically made of PVC) with a circular cross sections, although other shapes may also be used. In order to provide further control over the flow rate, it is desirable to maintain the original cross-sectional area of the tube.

In many of the above mechanisms, after a portion of the tube is deformed under the force of the fingers and the fingers are no longer applying force against the tube, the mechanism relies on the fluid that is under pressure to assist the deformed tube to open up as well as on the elastic nature of the tube to restore its shape to the undeformed state. However, as the portion of the tube that interacts with the pump is repeatedly deformed between the pressure pad and the fingers, the resiliency of the tube can be compromised and instead of the tube restoring itself to its original shape after each deformation, a non-elastic deformation of the tube may occur. While there are tubes that exhibit various degrees of resiliency, even the IV sets with highly resilient tubes, which typically are more expensive and may have to be custom made, may experience a short-term or long-term deformation as a result of counter forces exerted on the tube by the fingers and the pressure pad. Such a deformation may occur despite efforts to design and manufacture the components of the pump with appropriate tolerances for relieving excessive forces that may be generated between various components of the pump. An effect of such deformation of the tube is that it generally alters the cross-sectional area of the tube lumen and may reduce the amount of fluid flow to the patient per each occlusion of the tube by the fingers. As can be appreciated by those skilled in the art, such an occurrence is undesirable.

Also, in many of the previously designed pump mechanisms, the deformation of the tube between the fingers and the pressure pad occurs from the same directions throughout the operation of the pump. Such a design increases the possibility of creating a permanent deformation in the tube.

Thus, there is a need for an IV pump with a mechanism that substantially restores the shape of the tube to reduce the possibility of permanent deformation and change in the cross-sectional area of the inner lumen of the tube. Such an IV pump would enhance the accuracy, reliability, consistency, and predictability of fluid flow. The present invention fulfills these needs.

SUMMARY OF THE INVENTION

Briefly, and in general terms, the present invention is directed to a fluid delivery pump with a mechanism for improving the predictability, consistency, reliability, and accuracy of fluid flow rate through an IV tube and extending the useful life of the tube. After each deformation or occlusion of the tube, the mechanism incorporated in the pump of the invention aids in substantially restoring the cross-sectional area of the tube during the operation of the pump. By urging the restoration of the shape of the tube, the present invention strives to provide a consistent lumen size in the tube, so that the volume of fluid displaced by each pumping cycle of the mechanism remains substantially constant over time.

More specifically, an IV pump in accordance with the present invention comprises three groups of fingers associated and engaged with individual drive cams. The first group of fingers comprises two pinching fingers that alternatingly occlude a resilient, deformable tube against a pressure pad and release the tube which carries IV fluid to the patient. The alternate opening and closing of the pinching fingers means that at any given time one pinching finger always occludes the tube so that there is no direct flow path from the fluid supply to the patient and uncontrolled flow of fluid through the pump does not occur.

The second group of fingers comprises two pumping fingers that are alternatingly arranged with the two pinching fingers. The two pumping fingers alternatingly apply force sufficient to deform the tube without occluding it. The surface of each pumping finger which comes in contact with the tube is longer than the contact surfaces of the pinching fingers, while the contact surface of the upstream pumping finger is longer than the contact surface of the downstream pumping finger.

The third group of fingers driven by the cam shaft is comprised of four restoring fingers, each located adjacent to and associated with one of the pinching and pumping fingers. After each pinching or pumping finger finishes its downward closing cycle and retracts upward and away from the tube, the restoring finger that is adjacent to that finger advances in a rocking motion transverse to the longitudinal direction of the tube, and contacts the portion of the tube that has just been occluded by a pinching finger or deformed by a pumping finger. The rocking motion of the restoring fingers is accomplished by mounting an intermediate portion of each restoring finger (below the upper portion which is in contact with a cam) on a stationary pivot shaft which is parallel to the cam shaft. This allows each restoring finger to pivot about this pivot shaft such that its lower portion may move sideways towards or away from the tube.

In one aspect of the invention, the cams acting on the fingers are designed and oriented such that each pinching and pumping finger must retract from its advanced position in order to make room for a restoring finger to apply force on the tube. In applying a restoring force, each restoring finger acts on substantially the same axial length of the tube as one of the pinching or pumping fingers, and urges the occluded or deformed section of the tube to restore its cross-sectional shape. In addition, the alternate opening and closing of the pinching fingers means that at any given time, one pinching finger always occludes the tube, so that uncontrolled flow of fluid through the pump does not occur.

In other aspects of the invention, the restoring fingers apply force on the tube against the inner surface of individual plates which act as backstops. Also, the pinching and pumping fingers are designed to approach the tube and the pressure pad at an angle (and not perpendicularly) so as to assist the tube to roll away from the backstops, and thereby reduce unnecessary wearing on the surface of the tube, the fingers and the pressure pad. The angled movement of the pinching and pumping fingers also reduces the force necessary to occlude the tube, and reduces the chances of buckling of the tube wall.

The backstops are incorporated in the pressure pad, and are spring-loaded to individually move up under the biasing force of a spring until stopped by a backstop retainer bracket. During the downward angled movement of the pinching and pumping fingers, each finger comes in contact with the upper surface of a backstop, and pushes it down against the biasing force of the spring. When the backstop moves upward during the retraction of the pinching or pumping finger, the interior surface of the backstop provides a surface against which the tube can be pressed by the sideways (transverse) movement of the restoring finger.

Furthermore, the pressure pad used in the pump of the invention includes a recess for locating the backstops therein. The recess contains a slot for retaining the backstop springs. As stated, a backstop retainer bracket which may be connected to the pressure pad is also provided to limit the upward movement of the spring-loaded backstops. The pressure pad is incorporated in the door of the pump (via door-mounted retainers) which is opened in order to load the tubing therein. In order to accommodate assembly tolerances without creating excessive forces that may be applied on the tube between the fingers and the pad or applied between the spacers (described in the following paragraph) and the pressure pad, the pressure pad is preferably spring-loaded toward the fingers.

According to yet another aspect of the invention, a mechanism is provided to properly locate the pressure pad with respect to the fingers and to minimize the accumulation of design tolerances in the area where the tube is being manipulated. To accomplish these objectives, two stationary spacers, one at each end of the pump, are mounted on the rotating cam shaft and the stationary pivot shaft. The lower side of each spacer engages the upper surface of the pressure pad to ensure the proper vertical spacing of the pressure pad with respect to the fingers. The lower side of each spacer also includes a notch to engage a rib located on the upper surface of the pressure pad to ensure lateral alignment, while the door-mounted pressure pad retainers provide axial alignment of the pressure pad. Additionally, the lower side of each spacer includes a cut-out portion to allow the tube to run through the spacer.

From the foregoing, it can be appreciated that the fluid delivery pump of the invention improves the useful life of the IV tubing and increases the accuracy and consistency of the fluid flow rate through the tube. Although the tubing used in IV sets typically possess resilient characteristics, their performance in IV pumps can be advantageously enhanced by the mechanism of the invention which aids in restoring the shape of the tubing during the pumping operation. The restoration capability of the invention aids in preventing short or long-term deformation of the tube which can cause an unpredictable or inconsistent fluid flow over a period of time. These and other advantages of the invention will become more apparent from the following detailed description thereof, taken in conjunction with the accompanying exemplary drawings.

DETAILED DESCRIPTION OF THE PREFERRED EMBODIMENTS

Figure 1:
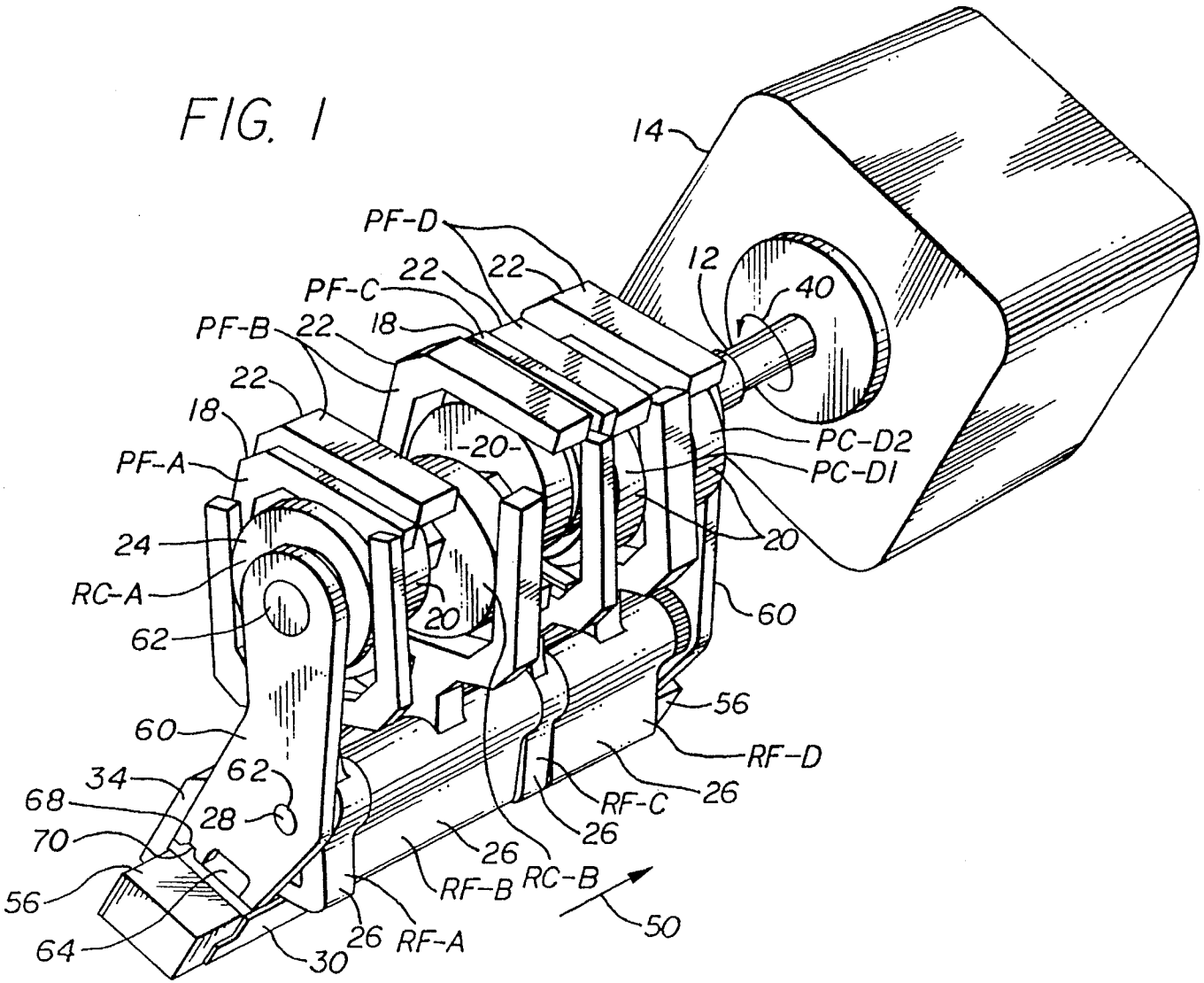
FIG. 1 is a perspective view of a pump mechanism embodying the present invention.

The present invention is embodied in a pump mechanism 10 as generally illustrated in FIG. 1. Pump 10 generally includes a plurality of pinching fingers 18 that alternatingly occlude a portion of a resilient, deformable tube 36 that carries IV fluid from an elevated reservoir to a patient (fluid reservoir and the patient not shown) against a pressure pad 30, a plurality of pumping fingers 22 interspaced adjacent the pinching fingers 18, wherein the pumping fingers 22 apply force to deform said tube for pumping the IV fluid downstream to the patient, and a plurality of restoring fingers 26 for urging each portion of the tube 36 that is occluded by the pinching fingers 18 or deformed by the pumping fingers 22 to restore its cross-sectional area. A motor 14 that rotates a cam shaft which is engaged with all of the fingers through individual pinching cams 16, pumping cams 20, and restoring cams 24 that are respectively associated with the pinching fingers 18, the pumping fingers 22, and the restoring fingers 26, provides the force necessary for the movement of the fingers.

Describing the operation of pump 10 in general terms, as the motor 14 rotates the cam shaft 12 and thereby the cams that are positioned on the cam shaft, the pinching fingers 18 and the pumping fingers 22 go up and down according to a predetermined pattern and order which results from the particular shape and orientation of each cam positioned on the cam shaft. At the end of its downward motion (fully advanced position), each pinching finger 18 occludes a portion of the tube 36 located under the finger against the pressure pad 30. After a period of occlusion, each pinching finger 18 retracts to a position that leaves the tube 36 in a partially deformed condition.

As to the pumping fingers 22, their advanced position flattens the portion of the tube 36 located under the pumping finger against the pressure pad 30 without occluding it, and their retracted position allows that portion of the tube 36 to be expanded to or nearly to its full cross-sectional area.

After each pinching or pumping finger 18 and 22 retracts from the tube 36 in an upward direction, a restoring finger 26 pivots about a stationary pivot shaft 28, so that a lower portion 38 of the restoring finger 26 moves in a transverse direction to apply force on the same portion of the tube that was earlier occluded or deformed. The restoring force is applied on the tube 36 against a backstop 32 incorporated in the pressure pad 30. Such a force urges the tube to restore its cross-sectional shape before the next downward movement of the pinching or pumping finger. The pump mechanism of the invention uses one restoring finger for every pinching or pumping finger and a separate backstop 32 for each restoring finger (e.g., backstop A is associated with restoring finger A, backstop B is associated with restoring finger B, etc.).

In more detail, with reference to FIG. 1, the cam shaft 12 is connected to the motor 14 which rotates in a direction as shown by arrow 40. The Motor 14 is preferably a stepper motor, however, other means that may result in the rotation of the cam shaft 12 may be used. The pump mechanism 10 preferably utilizes two pinching fingers 18 associated with two pinching cams 16, two pumping fingers 22, each associated with two pumping cams 20, and four restoring fingers 26 associated with four restoring cams 24. The two pumping fingers 22 and the two pinching fingers 18 are located adjacent one another in an alternating fashion. Alternatively, a different number of fingers or cams may be used to accomplish the same result.

Figure 2:
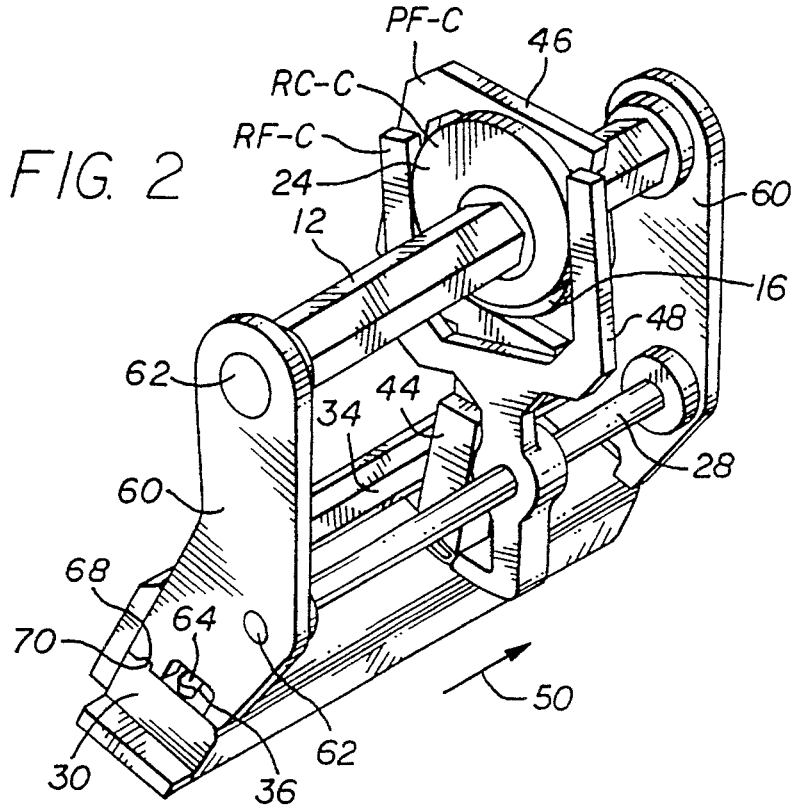
FIG. 2 is a perspective view of the pump mechanism shown in FIG. 1, with certain components of the pump removed to enable viewing of further details of one of the pinching fingers and one of the restoring fingers.
Figure 3:
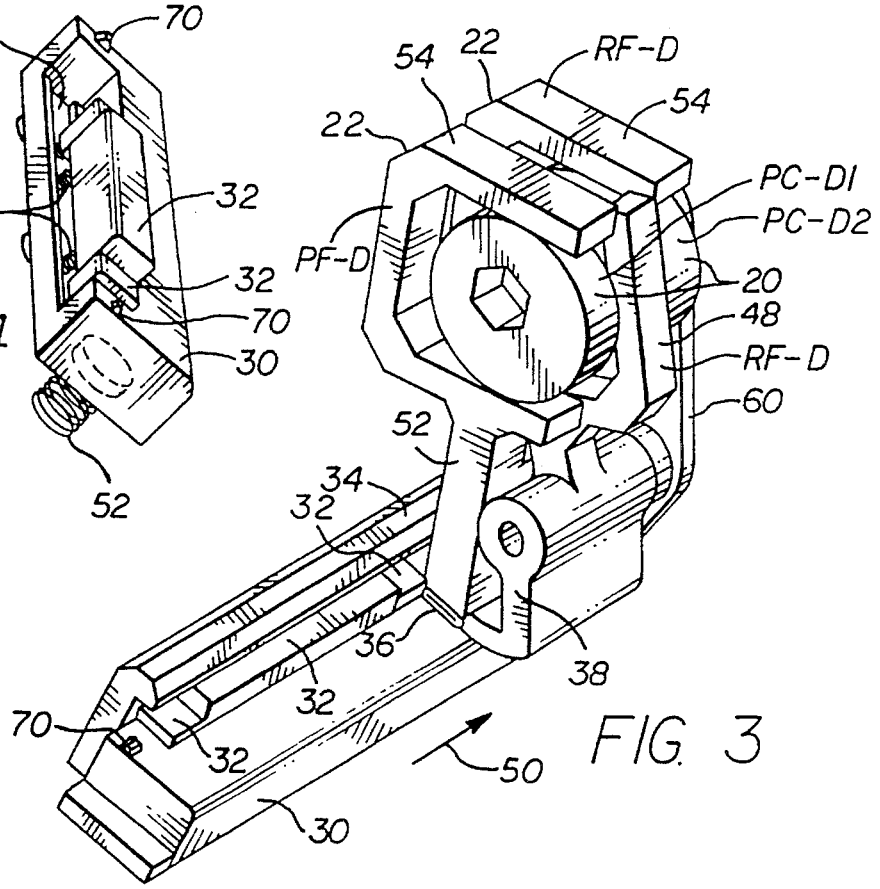
FIG. 3 is similar to FIG. 2 with certain components of the pump mechanism removed to enable viewing of further details of one of the pumping fingers and one of the restoring fingers.

For ease of identification, in FIG. 1, starting from the upstream end of the pump (see directional indicator 50 which points to the direction of fluid flow in the tube 36), each finger and each cam is identified by letters A through D. Therefore, starting from the upstream end of the pump, pinching finger A (PF-A) is in contact with pinching cam A (PC-A), pumping finger B (PF-B) is in contact with two pumping cams B1 and B2 (PC-B1 and PC-B2), pinching finger C (PF-C) is in contact with pinching cam C (PC-C), and pumping finger D (PF-D) is in contact with pumping cams D1 and D2 (PC-D1 and PC-D2). Similarly, we have restoring fingers A, B, C, and D (RF-A, RF-B, RF-C, and RF-D), respectively in contact with restoring cams A, B, C, and D (RC-A, RC-B, RC-C, and RC-D). Details of the association between pinching finger C with restoring finger C and the association between pumping finger D with restoring finger D are shown in FIGS. 2 and 3, respectively. In FIGS. 2 and 3, many of the components have been removed for better viewing of the specific fingers shown. More specifically, FIG. 2 shows pinching finger C and restoring finger C, while FIG. 3 shows pumping finger D and restoring finger D. The association between the remaining pinching and pumping fingers and their associated restoring fingers are similar to those shown in FIGS. 2 and 3.

A portion of the tube 36 is placed against the pressure pad 30 such that the tube 36 lies a fixed distance from and substantially parallel to the longitudinal axis of the cam shaft 12. The pressure pad 30 is contained within a hinged door of the pump which is opened for placing the tube between the pad and the fingers. Further details on the pressure pad and the door will be provided below.

The pump mechanism 10 of the invention is designed so that restoring finger A generally acts on the same portion of tube 36 as pinching finger A. The same relationship is true for restoring finger B and pumping finger B, restoring finger C and pinching finger C, and restoring finger D and pumping finger D. To accomplish this, pinching fingers A and C have the same width (along the length of the tube) in their lower portion 44 where they occlude the tube 36, while this width may be the same as or slightly larger than the width of a lower portion 38 of their respective associated restoring fingers A and C. The width of an upper portion 46 of pinching fingers A and C and an upper portion 48 of restoring fingers A and C are reduced in half so as to allow these upper portions to make contact with their associated cams that are located side by side on the cam shaft 12.

Although the lower portion 44 of pinching fingers A and C are shown to have a flat contact surface for occluding the tube 36 (see FIG. 2 showing pinching finger C), alternatively, the pinching fingers may be designed with other shapes and contours such as a wedge-shaped lower contact surface in order to provide tubing occlusion at lower force levels.

With respect to the pumping fingers 22, pumping finger B and restoring finger B are located adjacent to and between the A and C pinching and restoring fingers (see FIG. 1). Also, pumping finger D and restoring finger D are located downstream and adjacent to the C pinching and restoring fingers (see FIG. 1). As with the pinching fingers, the width of lower portion 52 of pumping fingers B and D is the same as or slightly larger than the width of lower portion 38 of restoring fingers B and D, respectively. However, as may be seen in FIGS. 2 and 3, the width of a lower portion 52 of each pumping finger is greater than the width of lower portion 44 of the pinching fingers. In addition, since the upstream pumping finger B must pump more fluid than the downstream pumping finger D (to fill an extra volume of tube under pinching finger C and pumping finger D), the width of the lower portion 52 of pumping finger B (and restoring finger B) is greater than the width of the lower portion 52 of pumping finger D (and restoring finger D).

Referring to FIGS. 1 and 3, the lower portion 52 of each of the pumping finger B and D is made of a continuous strip of material for applying a compressive force on tube, while an upper portion 54 of each pumping finger is split in two portions that make contact with two pumping cams 20 appropriately spaced along the cam shaft 12. This open slot created by the split design of the upper portion 54 of the pumping fingers allows restoring cams B and D and the upper portion 48 of restoring fingers B and D to be located midway between the split upper portions 54 of pumping fingers B and D, respectively. Accordingly, restoring fingers B and D can respectively contact restoring cams B and D without interference with pumping fingers B and D (see FIG. 3 as an example).

Figure 4:
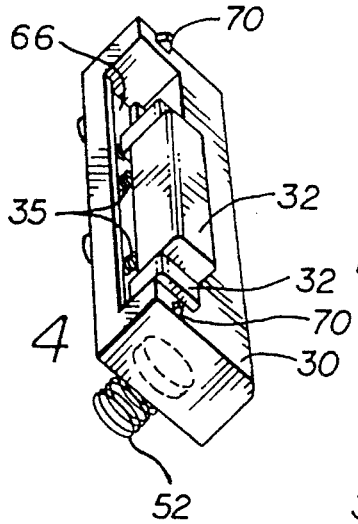
FIG. 4 is a perspective view of the pressure pad of the pump mechanism shown in FIG. 1, with certain components, namely one of the backstops and a backstop retainer, removed for better viewing of the remaining components.

As stated, the pressure pad 30 is incorporated in door 55 of the pump via door-mounted retainers 56 that hold both ends of the pressure pad secured to the door (see FIGS. 1, 5–8). The door 55 is preferably hinged and latched to the pump (latching mechanism also not shown). The pressure pad 30 is biased against the tube 36 by pressure pad springs 58 located between the door 55 and the underside of the pressure pad. The pressure pad springs 58 as shown in FIG. 4 are preferably three coil springs located under the pressure pad, one at the center and one at each end of the pressure pad. However, other biasing means such as leaf springs (not shown) located along the length of the pressure pad may alternatively be used.

Furthermore, as shown in FIGS. 4, the pressure pad used in the pump of the invention includes a recess 66 for locating the backstops 32 which provide a support surface against which the tube 36 is pressured by the restoring fingers. The length of each backstop 32 (measured along the length of the tube) is the same as the width (measured along the length of the tube) of the lower portions 44 and 52 of the associated pinching or pumping finger 18 and 22.

As shown in cross-sectional views in FIGS. 5–8, in the preferred embodiment of the invention, the pinching and pumping fingers 18 and 22 approach the tube 36 and pressure pad 30 at an angle and not perpendicularly. When the tube 36 is compressed by a pinching or pumping finger, the tube which has previously been pushed against the backstop by a restoring finger must move away from the backstop as it flattens. Unlike the motion of perpendicularly-moving fingers, the angled movement of the pinching and pumping fingers helps the tube to roll away from the corner formed by the pressure pad and the backstop, thus reducing undesirable wearing on the surfaces of the tube, fingers and pressure pad, and also reducing the force necessary to deform the tube. Furthermore, the angled movement of the fingers on the tube reduces the chances of the buckling of the tubing wall in such a way that the pinching fingers could not fully occlude the tube lumen.

The angular motion of the pinching and pumping fingers results in the lateral motion of the fingers during their stroke. This motion also causes the pinching and pumping fingers to contact the backstops 32, thus necessitating the backstops to be moveable within the pressure pad 30. As a result, each backstop 32 is spring loaded by placing backstop springs 35 (preferably coil springs) under each backstop in recess 66 which contains a slot 68 for retaining the backstop springs 35. Since the backstops are spring-loaded, they normally move up until stopped by a backstop retainer 34 which is connected to the pressure pad. Also, during the downward angled movement of the pinching and pumping fingers, each finger comes in contact with the upper surface of a backstop located below, and pushes it down against the biasing force of the backstop spring 35. When the backstop moves upward during the retraction of the pinching or pumping finger, the interior surface of the backstop provides a surface against which the tube can be pressed by the sideways (transverse) movement of the restoring finger.

With reference to FIGS. 1 and 2, preferably a pair of spacers 60 (one at each end of the pump) are provided to minimize the accumulation of design tolerances in the area where the tube is being manipulated by ensuring the proper location and spacing of pressure pad with respect to pinching and pumping fingers. Each spacer 60 has two apertures 62, one located at its upper end and the other located near its center. The upper and center apertures 62 are appropriately sized for respectively mounting the cam shaft 12 and the pivot shaft 28 therein. The lower end of each spacer has a cut-out portion 64 appropriately sized to allow for the passage of the tube 36 and the proper positioning of the tube into the mechanism during loading. The pressure pad 30 is biased by pressure pad springs 58 against the spacers 60 with enough force to ensure that it will not be dislodged by the force of the tube being occluded. The lower side of each spacer engages the upper surface of the pressure pad to ensure the proper vertical spacing of the pressure pad with respect to the fingers. The lower side of each spacer also includes a notch 68 to engage a rib 70 located on the upper surface of the pressure pad (one rib 70 at each end; see FIG. 4) to ensure lateral alignment, while the door-mounted pressure pad retainers 56 provide axial alignment of the pressure pad. Additionally, the lower side of each spacer 60 includes a cut-out portion 64 appropriately sized to allow for the passage of the tube 36 and the proper positioning of the tube into the mechanism during loading.

In order to better illustrate the complete cycle of the pump mechanism, FIGS. 5–8 show a series of cross-sectional views taken at points along the length of the pump mechanism 10 to show the interaction between the pinching and pumping fingers with their associated restoring fingers at the beginning of the operational cycle of the pump of the invention.

Figure 5:
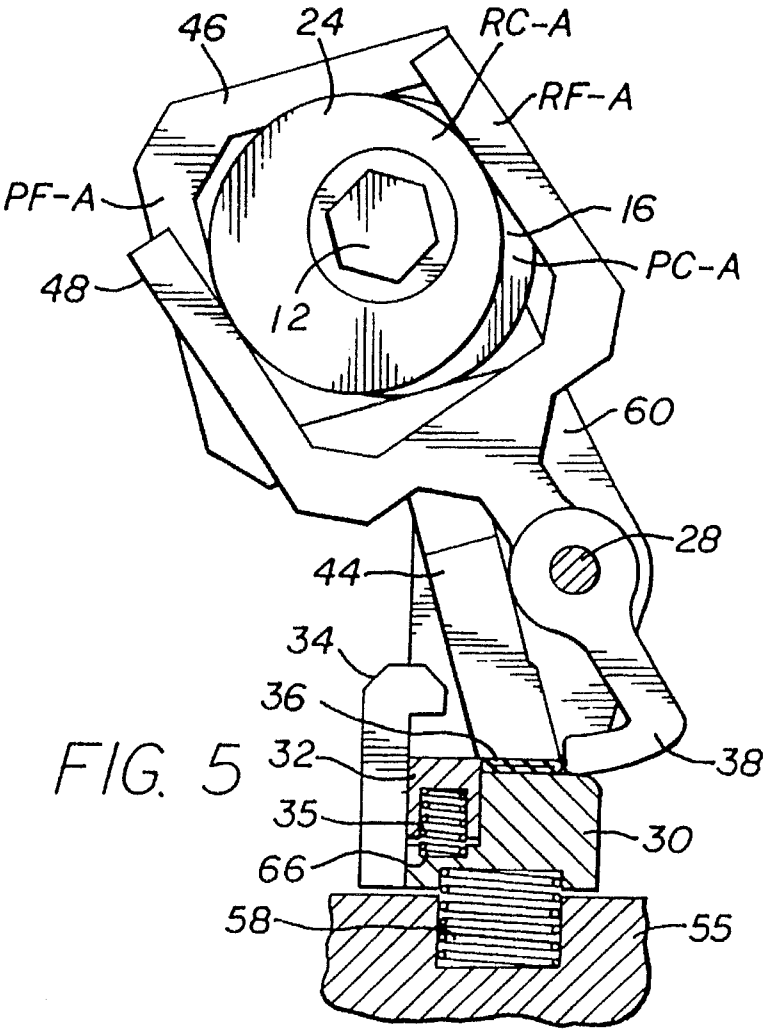
FIG. 5 is a cross-sectional view of the pump mechanism shown in FIG. 1, showing the upstream pinching finger and restoring finger.

FIG. 5 shows pinching finger A and restoring finger A at the beginning of the mechanism cycle. At this point in time, pinching finger A has fully advanced to occlude the tube 36 against the pressure pad 30, and restoring finger A has retracted so as not to interfere with the motion of pinching finger A and to make room for the flattened tube to expand sideways. The retracted restoring finger A and backstop A (lowered under the force of pinching finger A) help to maintain the tube under pinching finger A.

Figure 6:
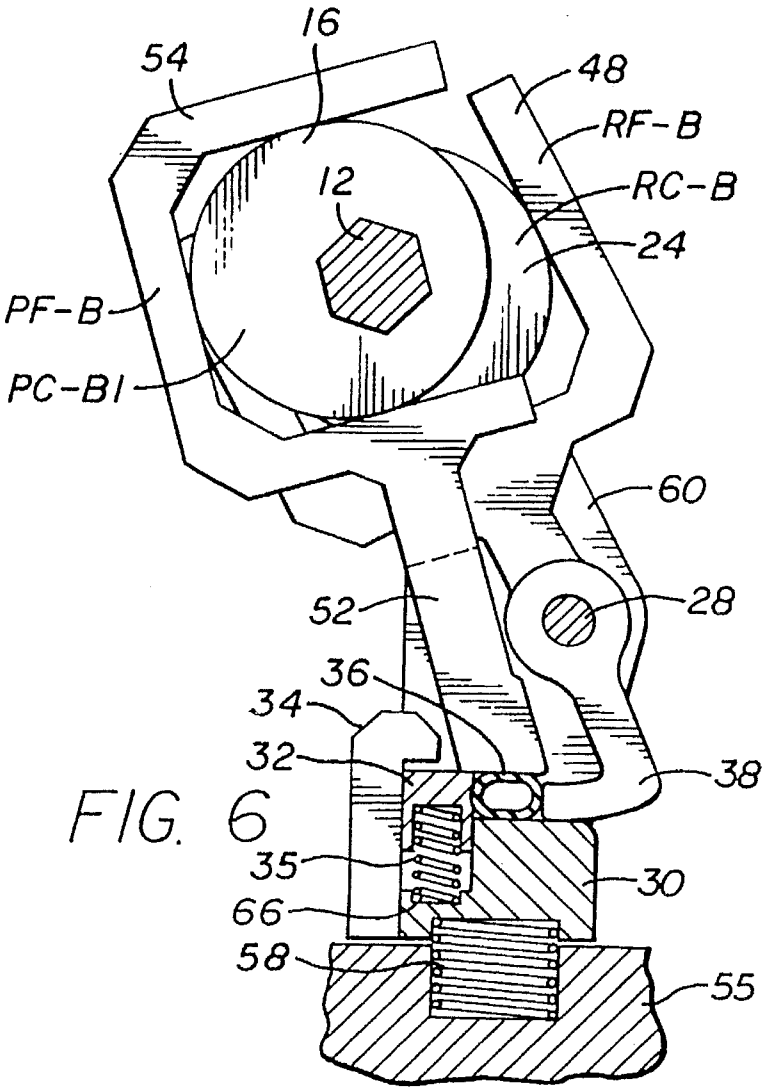
FIG. 6 is a cross-sectional view of the pump mechanism shown in FIG. 1, showing the upstream pumping finger and restoring finger.

FIG. 6 shows pumping finger B and restoring finger B in their respective positions at the start of a mechanism cycle. Pumping finger B is fully retracted, while restoring finger B is advanced to force the tube 36 to an open condition. As can be seen in FIG. 6, since pumping finger B is in its retracted stage, the backstop has moved up under the biasing force of the backstop spring 35 acting on backstop B. Thus, backstop B provides the support surface needed for restoring finger B to apply force on the tube 36 and urge the tube to move from a flattened condition to an open shape. It must be noted that in FIG. 6, only one of the two pumping cams 20 (the upstream cam) is shown.

Figure 7:
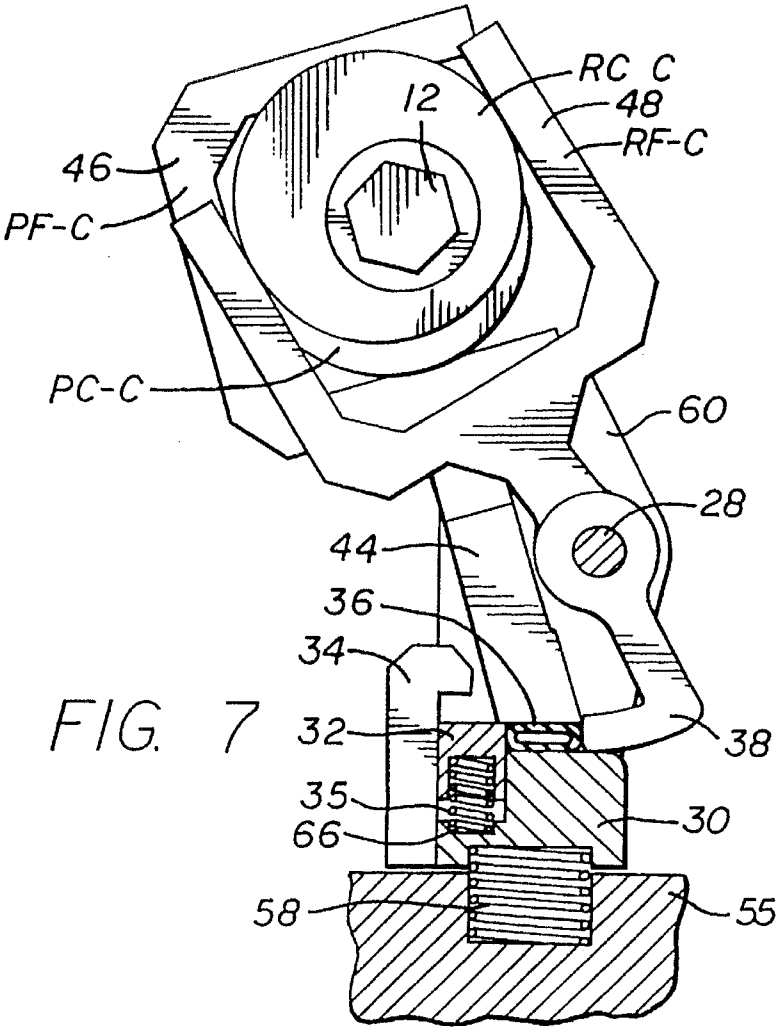
FIG. 7 is a cross-sectional view of the pump mechanism shown in FIG. 1, showing the downstream pinching finger and restoring finger.

FIG. 7 shows pinching finger C in its retracted position, while restoring finger C has moved toward the tube 36 as far as possible (without interfering with pinching finger C) in order to urge the previously occluded tube to assume an open condition. Again, backstop C has moved up under the biasing force of its spring 35, and provides the support surface for restoring finger C to apply a restoring force on the tube.

Figure 8:
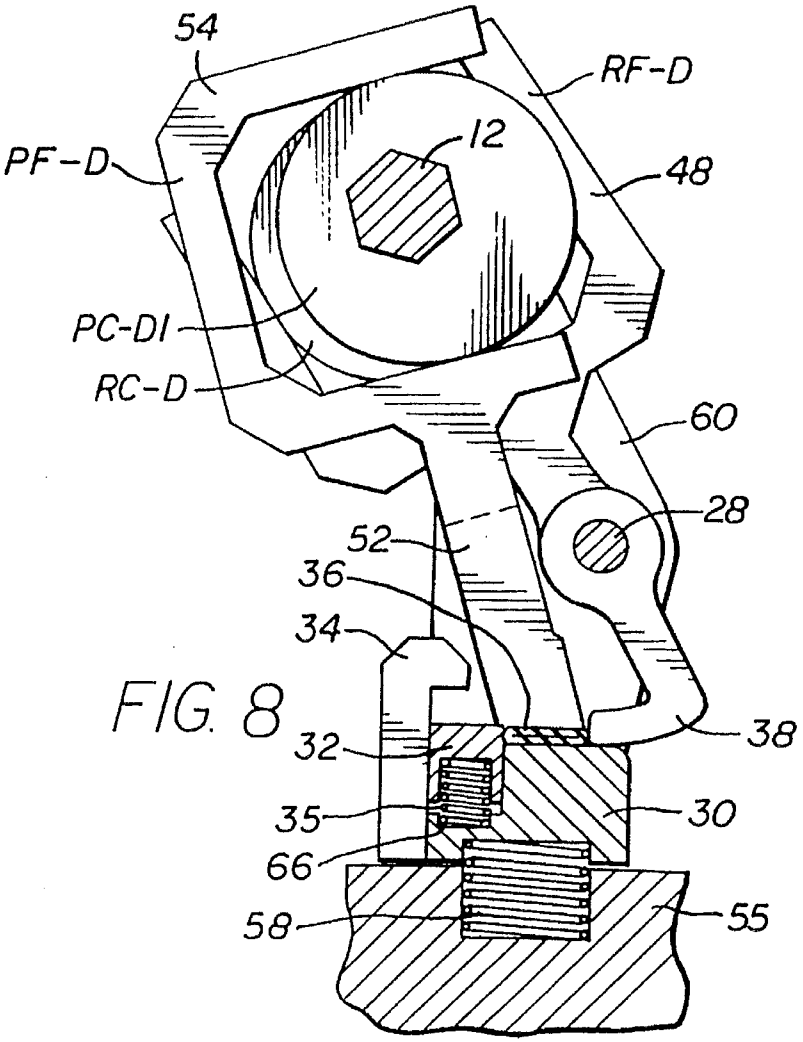
FIG. 8 is a cross-sectional view of the pump mechanism shown in FIG. 1, showing the downstream pumping finger and restoring finger.

FIG. 8 shows pumping finger D and restoring finger D in their respective positions at the start of a mechanism cycle. At this point, restoring finger D is fully retracted so as not to interfere with pumping finger D which is fully advanced at the end of its pump stroke to flatten, but not occlude, the tube 36 against the pressure pad 30. At the same time, backstop D (which has been depressed by pumping finger D) and the retracted restoring finger position the tube under pumping finger D.

FIGS. 5–8 serve a double purpose in that in addition to showing the relative positions of the pump components at the beginning of the mechanism cycle, these figures also show the opposite extreme positions of the components of the pump which results from the rotation of the cam shaft 12 and the cams associated with the fingers. More specifically, with respect to FIG. 5, in addition to showing the relative positions of pinching finger A and restoring finger A at the start of the cycle, this figure also represents the opposite extreme positions of pinching finger C and restoring finger C (as compared to the one shown in FIG. 7). Similarly, FIG. 7 illustrates the positions of pinching finger C and restoring finger C at the start of the cycle, as well as, the opposite extreme positions of pinching finger A and restoring finger A (as compared to the one shown in FIG. 5).

As to pumping fingers 22, FIG. 6 shows the positions of pumping finger B and restoring finger B at the start of the cycle, as well as, the opposite extreme positions of pumping finger D and restoring finger D (as compared to the one shown in FIG. 8). Similarly, in addition to showing the positions of pumping finger D and restoring finger D at the start of the cycle, FIG. 8 also shows the opposite extreme positions of pumping finger B and restoring finger B (as compared to the one shown in FIG. 6).

Figure 9:
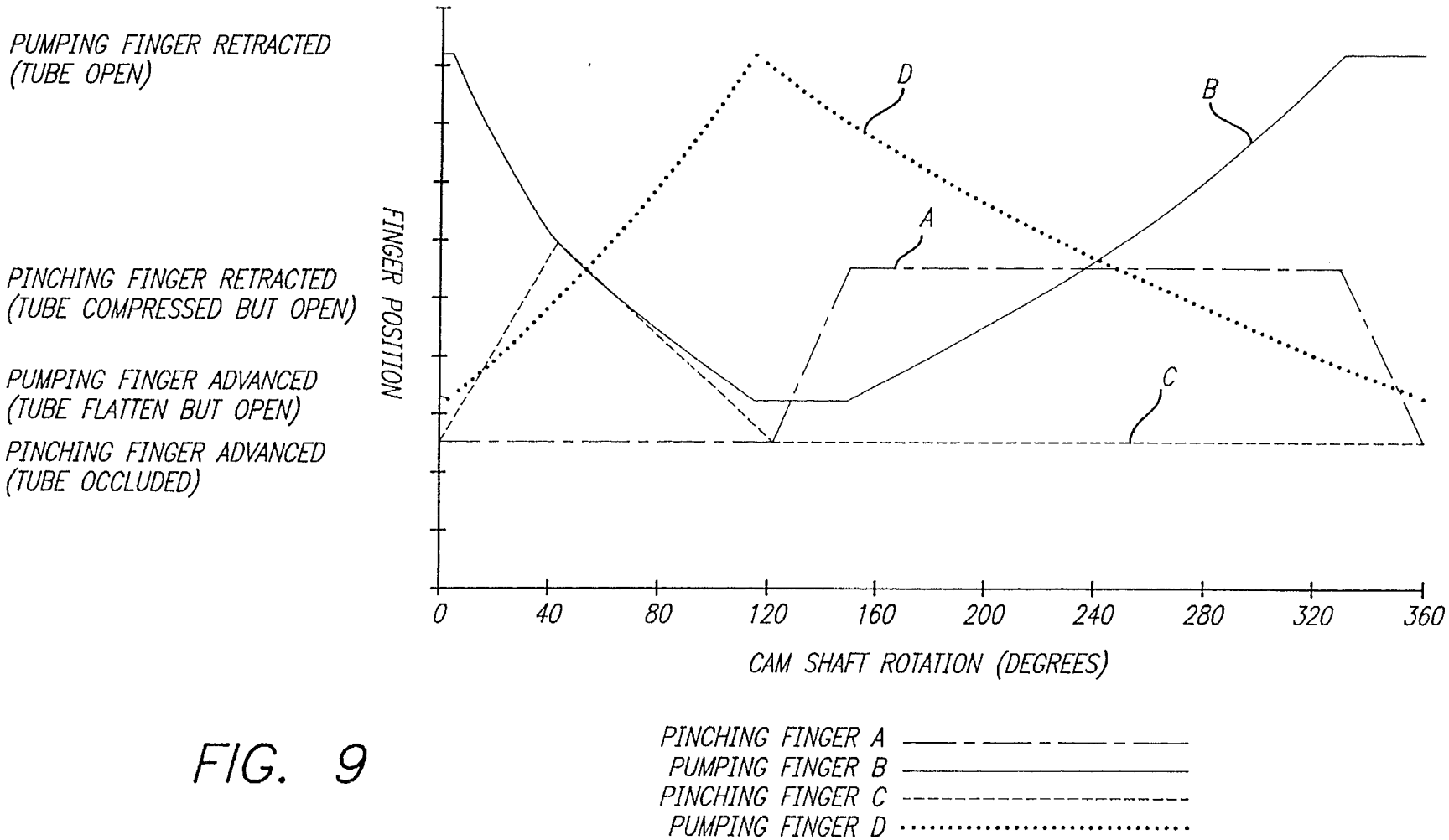
FIG. 9 is a graphical representation of the relative motions of the pinching and pumping fingers of the pump mechanism shown in FIG. 1.

The complete operational cycle of the pump of the invention is graphically illustrated by an X–Y plot in FIG. 9. The X axis represents the degrees of cam shaft rotation, and the Y axis represents the position of the pinching and pumping fingers with the cross-sectional opening of the tube under the motion of the pinching and pumping fingers shown in parentheses. The positions of pinching finger A, pumping finger B, pinching finger C, and pumping finger D are respectively represented by four lines designated as A, B, C, and D. The 0° position of the cam shaft that is chosen as a reference point for the beginning of a cycle is the position of the cam shaft which causes the pinching and pumping fingers to assume the positions as shown in FIGS. 5–8. As can be seen in FIG. 9, the lowest (most advanced) positions of pinching fingers A and C cause the tube to occlude, and their highest (fully retracted) positions leave the tube in a partially compressed condition. Also, in their lowest positions, pumping fingers B and D leave the tube in a flattened but not occluded condition, whereas in their highest positions they move away from the tube a distance which can allow the tube to open to its substantially full cross-sectional area.

In FIG. 9, the cycle of the pump mechanism is shown to start with pinching finger A occluding the tube, pumping finger B at the start of a pump stroke (in its fully retracted position and ready to advance toward the tube), pinching finger C starting to retract and release the tube, and pumping finger D at the start of a fill stroke (in its most advanced position and ready to retract from the tube). These are the same positions as shown in FIGS. 5–8.

After about 45° of cam shaft rotation, pinching finger C which has reached its most retracted position, begins to advance toward the tube. At approximately 115° of cam shaft rotation, pumping finger B has reached its most advanced position, and pumping finger D begins its pump stroke (advancing toward the tube from its fully retracted position). Once pumping finger B reaches its most advanced position, it maintains that position for another 40° of cam shaft rotation, and then begins its fill stroke at about 155° of cam shaft rotation. At about 125° of cam shaft rotation, pinching finger A retracts, and pinching finger C has occluded the tube. At approximately 330° of cam shaft rotation, pumping finger B reaches its fully retracted position which is maintained until the beginning of the next cycle, and pinching finger A begins to close down on the tube.

FIG. 9 also shows that the alternate opening and closing of the tube by pinching fingers A and C means that at any given time, the tube is fully occluded at some point along its length, so that uncontrolled free flow from the fluid reservoir to the patient cannot occur. Additionally, FIG. 9 shows that the endpoints of the motion of pumping fingers B and D do not coincide in time (i.e., based on degrees of cam shaft rotation) with the endpoints of motion of pinching fingers A and C. This is due to the fact that as a safety feature to accommodate tolerances in the mechanism and in the wall thickness of the tube, the pinching fingers are actually driven past the point at which they occlude the tube. The motions of pumping fingers B and D are therefore timed to coincide with the positions of the cycle at which pinching finger C nominally occludes or releases the tube. This feature is part of the overall design that assists the pump of the invention to obtain uniform flow throughout the mechanism pump cycle.

Thus, the pump mechanism of the invention advantageously provides for continuous and uniform flow throughout the pump cycle. The pump mechanism of the invention takes into account that in order to enhance the uniformity of flow, it is desirable to maintain a constant rate of change in tubing cross-sectional area by reducing the rate of deformation of the tube. To achieve this goal, the pumping motions of the B and D pumping fingers are designed to have a higher velocity at the start of their pump strokes, and a lower velocity at the end of their pump strokes. In addition, the velocity of pumping finger B is designed to change to accommodate the motion and volume displacement of pinching finger C and pumping finger D.

As can be appreciated, various modifications can be made to the present invention. For example, the restoring cams which are in contact with the restoring fingers could be mounted on a second rotating cam shaft that would be separate from the cam shaft 12 that controls the movement of the pinching and pumping fingers. One of the cam shafts could be connected to the motor and the other cam shaft could be operatively connected to the first cam shaft (such as by mounting interlocking gears on the two cam shafts). However, such a configuration has at least one disadvantage in that if a single motor is to be used to run both cam shafts, it would require an additional cam shaft and means to transfer the rotation of one cam shaft to another.

From the foregoing, it will be appreciated that the pump of the invention provides a mechanism with fingers that pump the IV fluid through the tubing, and other fingers that aid in restoring the cross-sectional shape of the tubing during the operation of the pump. The ability to urge the restoration of the shape of the tubing provides a substantially consistent tube lumen size, so that the volume of fluid displaced remains substantially constant over time. Thus, the pump of the invention advantageously enhances the accuracy and reliability of the fluid flow rate, extends the useful life of IV tubing, and allows the use of low cost IV sets. Furthermore, the pump of the invention advantageously provides for a continuous and uniform flow of the fluid to the patient.

While particular forms of the invention have been illustrated and described, it will be apparent that various modifications can be made to the present invention without departing from the spirit and the scope thereof.

What is claimed is:

1. A pump for delivering fluid through a resilient, deformable tube, comprising:

first and second support means for supporting said tube;

pinching means for occluding said tube against said first support means and then releasing said tube;

pumping means for deforming said tube against said first support means, so that fluid is pumped through said tube;

restoring means for applying force on said tube against said second support means, so that said tube is urged to restore said tube's cross-sectional shape; and drive means for actuating said pinching means and said pumping means and said restoring means.

2. The pump of claim 1, wherein said pinching means, said pumping means, and said restoring means are operatively engaged with a cam shaft, and said cam shaft is operatively engaged with said drive means.

3. The pump of claim 2, wherein said pinching means includes a plurality of pinching cams engaged with said cam shaft and a plurality of pinching fingers engaged with said pinching cams.

4. The pump of claim 2, wherein said pumping means includes a plurality of pumping cams engaged with said cam shaft and a plurality of pumping fingers engaged with said pumping cams.

5. The pump of claim 2, wherein said restoring means includes a plurality of restoring cams engaged with said cam shaft and a plurality of restoring fingers engaged with said restoring cams.

6. The pump of claim 5, further comprising pivot means, wherein said restoring fingers pivot about said pivot means for applying force on said tube.

7. The pump of claim 5, wherein said restoring fingers apply force on said tube from a direction substantially transverse to the direction of fluid flow in said tube.

8. The pump of claim 1, wherein said first support means is biased against said tube and said pinching means and said pumping means.

9. The pump of claim 1, wherein said second support means is biased against said pinching means and said pumping means.

10. The pump of claim 1, further comprising spacer means for spacing said first support means from said pinching means and said pumping means.

11. A pump for delivering fluid through a resilient, deformable tube, comprising:

a first pressure pad;

a second pressure pad;

a plurality of pinching fingers that apply force to occlude said tube against said first pressure pad;

a plurality of pumping fingers to apply force to deform said tube against said first pressure pad without occluding said tube;

a plurality of restoring fingers to apply force on said tube against said second pressure pad to urge said tube to restore said tube's cross-sectional shape; and a motor for actuating said pinching fingers and said pumping fingers and said restoring fingers.

12. The pump of claim 11, wherein said first pressure pad is biased against said pinching fingers and said pumping fingers.

13. The pump of claim 11, wherein said restoring fingers pivot about a pivot shaft.

14. The pump of claim 11, wherein said restoring fingers apply force on said tube from a direction traverse to the longitudinal axis of said tube.

15. A method for delivering fluid through a resilient, deformable tube in a pump having first support means and second support means for supporting said tube, drive means for generating a pumping action on said tube, pinching means operatively engaged with said drive means for applying force on said tube to occlude said tube, pumping means operatively engaged with said drive means for applying force on said tube without occluding said tube, restoring means operatively engaged with said drive means for applying force on said tube against said second support means to urge the restoration of the cross-sectional shape of said tube, said method comprising:

placing said tube against said first support means, advancing said pinching means to occlude said tube under the force of said pinching means and retracting said pinching means, advancing said pumping means on said tube to compress said tube under the force of said pumping means and retracting said pumping means, and urging said occluded or compressed tube to restore its cross-sectional shape under the force of said restoring means.

* * * * *